US006058527A

United States Patent [19]

Charpin

[11] Patent Number: 6,058,527

[45] Date of Patent: May 9, 2000

[54] MOBILE AND PIVOTING CIRCULAR PLATFORM FOR TRANSFERRING A HANDICAPPED PERSON

[76] Inventor: Xavier Charpin, 5, impasse des Canuts, F-42390 Villars, France

[21] Appl. No.: 09/171,796

[22] PCT Filed: Feb. 27, 1998

[86] PCT No.: PCT/FR98/00382

§ 371 Date: Oct. 29, 1998

§ 102(e) Date: Oct. 29, 1998

[87] PCT Pub. No.: WO98/38959

PCT Pub. Date: Sep. 11, 1998

[30] Foreign Application Priority Data

Mar. 3, 1997 [FR] France ..... 97 02710
Oct. 29, 1997 [FR] France ..... 97 13817

[51] Int. Cl.[7] ..... A61G 7/10

[52] U.S. Cl. ..... 5/81.1 RP; 5/86.1

[58] Field of Search ..... 5/81.1 RP, 81.1 R, 5/86.1

[56] References Cited

U.S. PATENT DOCUMENTS

| | | | |
|---|---|---|---|
| 2,757,388 | 8/1956 | Chisholm | 5/81.1 RP |
| 2,963,713 | 12/1960 | Forrest | 5/81.1 RP |
| 2,975,435 | 3/1961 | Forrest | 5/81.1 RP |
| 3,940,808 | 3/1976 | Petrini | 5/81.1 RP |
| 4,279,043 | 7/1981 | Saunders | 5/81.1 RP |
| 5,054,137 | 10/1991 | Christensen | 5/81.1 RP |
| 5,507,044 | 4/1996 | Williamson et al. | 5/81.1 RP |

FOREIGN PATENT DOCUMENTS

| | | | |
|---|---|---|---|
| 2 526 312 | 11/1983 | France | 5/81.1 RP |
| 27 49 146 A1 | 5/1978 | Germany . | |
| 2 214 424 | 9/1989 | United Kingdom . | |

*Primary Examiner*—Alexander Grosz
*Attorney, Agent, or Firm*—Oliff & Berridge, PLC

[57] ABSTRACT

The baseplate (1) is made up of a circular metallic disk of approximately the same diameter as the plate (2) while, on the one hand, the plate (2), also made of a metal plate, is secured to a protective circular edging (1*b*) extending right down to the baseplate and, on the other hand, the lower members (4*a*) of the two uprights are connected by a horizontal crossmember (10) which, placed at adult knee height, is itself reinforced by an inclined bar (11) extending between this crossmember and the front part of the plate (2).

10 Claims, 2 Drawing Sheets

MOBILE AND PIVOTING CIRCULAR PLATFORM FOR TRANSFERRING A HANDICAPPED PERSON

Figure 1:
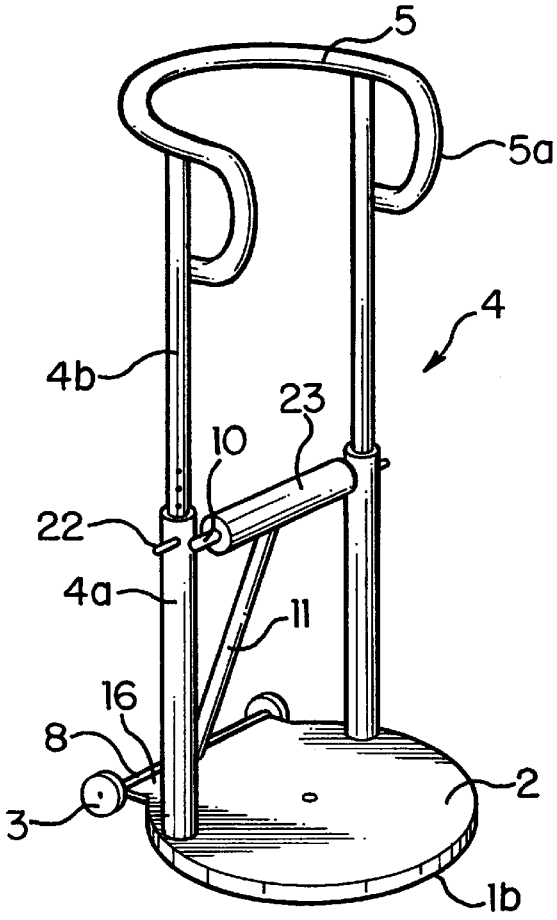

The present invention relates to a mobile and pivoting circular platform for transferring a motor-handicapped individual, for example from his chair to a toilet seat or to his bed and vice versa.

It is well known that the operation of transferring an invalid from a chair to a toilet seat or to a bed or vice versa, is performed with the help of one or more people, accompanied by the difficulties inherent to the weight of the invalid and the lack of mobility in his lower limbs. The task of turning the invalid round and getting him out of his chair is all the trickier because rest rooms are always tight on space.

The state of the art, and in particular U.S. Pat. No. 2,963,713, DE-A-2 749 146, U.S. Pat. No. 5,507,044 and FR-A-2 526 312, describe devices which employ a baseplate on which there is mounted so that it can pivot, a plate bearing a support with a handrail, and which therefore allow the invalid to be pivoted through 180° once this invalid has been installed, standing up, on the plate. Furthermore, in the first two documents, the device has integral wheels which allow the device to be shifted when unladen, for example, to bring it up close to a toilet pan or to take it away for storage.

None of these devices satisfies the constraints imposed by the non-functionality of the lower limbs, namely:

- a plate-baseplate assembly which is of small thickness to make it easier for an invalid who moves along dragging his feet to gain access to it,
- hand grip means easy to access, creating no regions on which the handicapped individual or the helper might become caught,
- the space for accommodating the feet being unencumbered by obstacles in order to prevent any catching when the invalid is taking his place thereon,
- stability of the way in which the invalid is held in each position and during turning,
- simple and easy handling.

The object of the present invention is to provide a simple piece of apparatus in the form of an extremely low platform which, allowing the invalid to be stood up more easily, is equipped with a very robust handrail which allows this handicapped individual to hold himself upright for the very short moment during which he is pivoted to bring his posterior to face a toilet seat or a bed, before he can sit down without any twisting or effort from his lower limbs.

The invention therefore relates to a platform made up of a baseplate, a circular plate mounted so that it can pivot on the baseplate with the interposition of means for centering it, guiding its rotation, and supporting it, a handrail in the shape of an arc of a circle connected to the plate by two telescopic uprights and two wheels mounted so that they are free to rotate at the ends of an axle parallel to a diameter of the plate, outside the latter and arranged on the opposite side to the region via which this plate is accessed, the wheels being arranged in such a way that they come into contact with the ground only when the platform is tipped toward them.

According to the invention the baseplate consists of a circular metallic disk of approximately the same diameter as the plate while, on the one hand, the plate, which also consists of a metal sheet, is secured to a protective circular edging extending right down to the baseplate and, on the other hand, the members of the two uprights are connected by a horizontal crossmember which, placed at adult knee height, is itself reinforced by an inclined tube extending between this crossmember and the front part of the plate.

By virtue of this arrangement, access to the platform is easier and, if need be, by resting his shins or knees against the horizontal crossmember, the invalid can stand himself up by pulling with his arms, gripping the handrail, without this generating a tipping moment that would disturb his stability.

Advantageously, each of the ends of the arc-shaped handrail is extended, beyond where it is attached to the upright, by a return bent into a semicircle and downward.

Each bent return thus forms a handgrip which, being easier for the invalid to grasp in the phase in which he is standing himself up, has the advantage of having no edges which may catch on his clothing or that of the helpers.

Other features and advantages will emerge from the description which follows with reference to the appended diagrammatic drawing which depicts, by way of example, one embodiment of the platform according to the invention.

Figure 2:
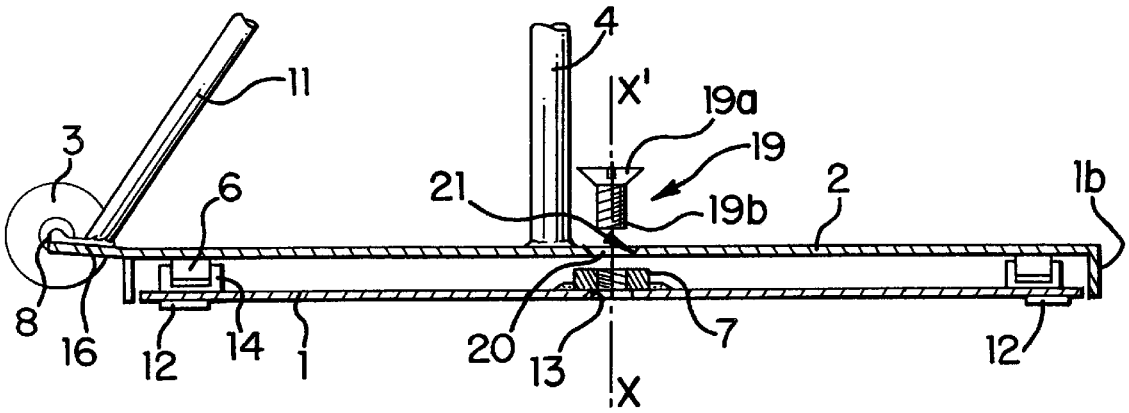
Figure 3:
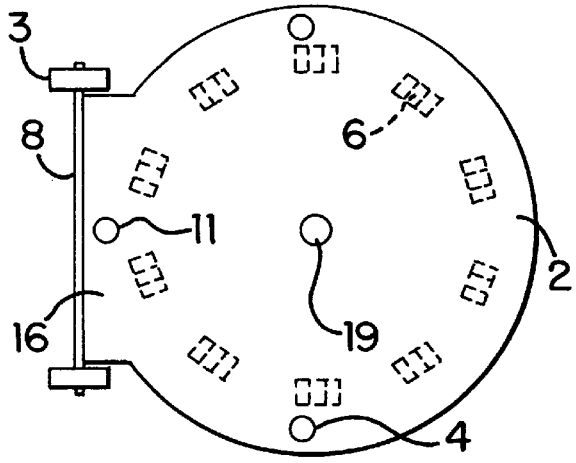
Figure 4:
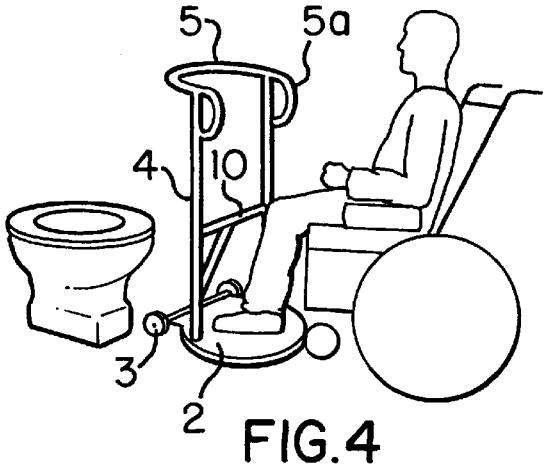
Figure 5:
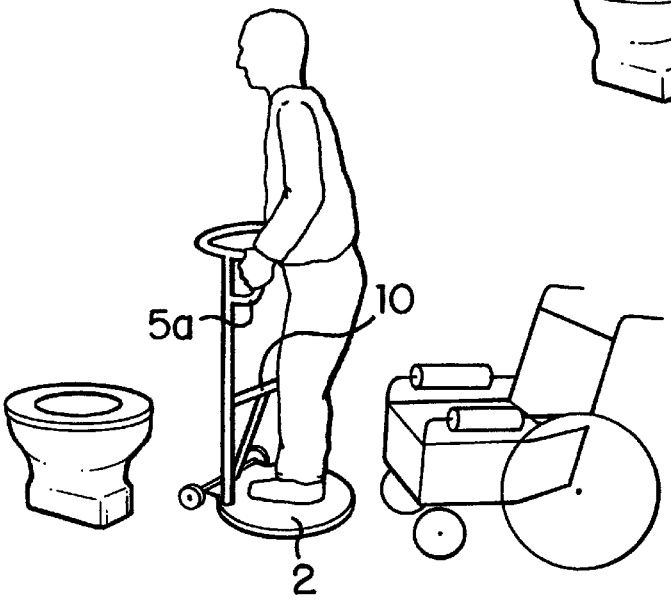
Figure 6:
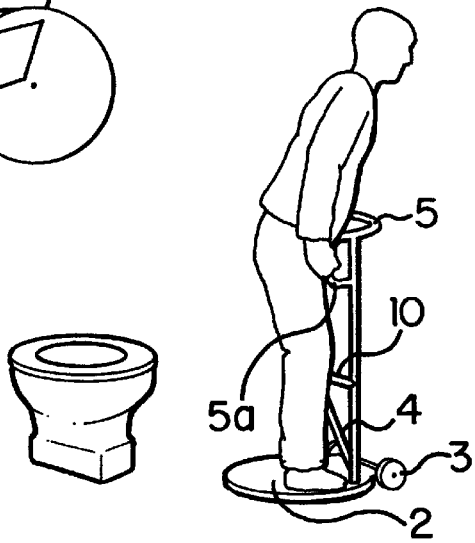

FIG. 1 is a view in perspective of one embodiment of the platform according to the invention, FIG. 2 is a partial view of the lower part of this platform in longitudinal section, FIG. 3 is a plan view of the platform, from above, FIGS. 4, 5 and 6 are perspective views showing several phases in the use of the platform for transferring an invalid sitting in a wheelchair to a toilet seat, namely the phase of positioning his feet on the platform, the phase of standing the invalid up, and the phase of turning before seating him on the toilet seat.

This platform comprises a baseplate 1 for resting on the ground, which baseplate consists of a metal disk, and a plate 2, which also consists of a metal sheet. The plate 2 supports two metal tubular uprights 4 which are welded to it more or less one on each side of its transverse mid-plane, that is to say one on each side of its vertical axis x'–x of rotation with respect to the baseplate. These uprights support a handrail 5.

As shown in greater detail in FIG. 2, the baseplate 1 is equipped, against its underside, with a number of patches 12 made of a synthetic substance or of a rubber, which are bonded to it in order to limit noise and slippage on the ground. Passing axially through this baseplate is a bore 13 which is coaxial with the tapping of a flanged nut 7 welded to it. Also welded to its upper face are supports and, for example, the clevis blocks 14 that bear rollers or castors 6.

FIG. 3 shows that these rollers are distributed in a circle with a more or less constant angular spacing, about the vertical axis x'–x of rotation of the plate 2.

This plate 2 has, when seen from above, a circular overall shape and extends forward in the form of a radial and rectangular tang 16. This tang, or at least its edge, is turned upward, as shown in FIG. 2 in order to raise a rod 8 which is welded to it, parallel to its front edge. The ends of this rod 8, which protrude beyond the tang 16, constitute an axle about which two wheels 3 can rotate.

These wheels are slightly raised off the ground so that they come into contact with it only when the entire platform assembly is tilted toward them.

The circular part of the plate 2 has a diameter approximately equal to that of the baseplate 1, and more specifically exceeds this diameter by the thickness of the sheet of which a circular edging 1*b* is made. This edging is welded to the plate and extends vertically almost down as far as the baseplate 1, that is to say down to the middle of the thickness thereof. Its function is to protect the rollers 6 against the ingress of any foreign bodies, and also to protect the handicapped individual's feet by preventing them from becoming trapped between the plate 2 and the baseplate 1 as he attempts to climb onto the plate.

In addition to the means of supporting the plate 2, which consists of the rollers 6, the plate comprises means for guiding its rotation, which means consist of a vertical screw 19 which has a countersunk head 19*a* and a threaded end 19*b*. This screw fits freely into an axial bore 20 formed in the plate 2 and which has a countersink 21 capable of accommodating the head 19*a*. Its threaded part 19*b* is screwed into the flanged nut 7 borne by the baseplate 1.

It will be noted that by virtue of this arrangement, the means of guiding the rotation of the plate and of supporting it are very compact, while at the same time offering the plate 2 excellent stability.

In the embodiment depicted, each of the tubular uprights 4 is telescopic, that is to say is made up of a lower member 4*a* connected to the plate 2 and of an upper member 4*b* mounted so that it can slide with respect to it. Close to its upper end, each lower member 4*a* is equipped with a means 22 such as a radial screw, lever and cam, transverse pin or tightener allowing the upper member 4*b* to be prevented from translational movement in this lower member.

This means of adjustment is beneficial in two respects:

it allows the height of the handrail 5 to be adjusted to suit the size of the handicapped individual, and it also reduces the packaged height of the platform.

The handrail 5 forms an arc of a circle which extends around the front of the platform, without it any way overhanging the plate 2. Each of its arc-shaped ends is extended beyond where it is attached to the upright 4*d* by a return 5*a*, bent downward in the form of a semicircle, and the end of which is fixed, by welding, to the upper member 4*b*. These returns 5*a* form handgrips, the usefulness of which will be specified later.

Finally, and according to another feature of the invention, each lower member 4*a* of an upright is connected to the same upright member by a horizontal crossmember 10 arranged near its upper end. The distance between this crossmember and the plate 2 is approximately equal to knee height for an adult of average size, so as to allow the handicapped individual to stand himself up with greater ease by resting his knees against it.

In one embodiment, this crossmember is welded to each of the members 4*a*. It is strengthened by a reinforcing bar 11 which extends between it and the plate 2 and which is therefore inclined. This crossmember, arranged in the longitudinal mid-plane of the platform is, in this embodiment, welded by each of its ends to the crossmember 10 and to the plate 2, respectively.

In another embodiment, the crossmember 10 is equipped, at each of its ends, with a clamping collar with a means of immobilization on the corresponding lower member 4*a*. In this version, the reinforcing bar 11 is made up of two telescopic elements associated with means of immobilization in translation and each of its ends is connected to the crossmember 10 and to the plate 2 respectively by an articulation. This arrangement allows the vertical position of the crossmember 10 to be adjusted to suit the size of the user, and therefore the position of his knees with respect to the plate 2.

Advantageously, the crossmember 10 is surrounded by at least one sleeve 23 made of an elastically compressible material, such as a synthetic foam, improving its comfort as a knee rest.

When such a platform has been set in place close to a toilet seat, as shown in FIG. 4, the handicapped individual can come up close to it in his wheelchair until he can place his feet on the platform 2 and then, from there, and as shown in FIG. 5, grasp hold of the handgrips formed by the returns 5*a* of the handrail in order to stand himself up vertically, possibly helping himself by resting his knees against the crossmember 10. At this stage, assistance from third parties is essential for pivoting the plate 2 and the handicapped individual through 180° into the position depicted in FIG. 6. In this position, the handicapped individual may, by himself, having removed the necessary items of clothing, sit down on the toilet seat. Afterwards, he can stand himself up again unaided.

It is clear that this particularly simple and inexpensive platform makes the handicapped individual's movements of standing up and sitting down easier, while at the same time offering him, while he is performing these movements, perfect stability and means of making these movements easier to perform.

What is claimed is:

1. Pivoting and mobile circular platform for transferring handicapped individuals, of the type made up of a baseplate, a plate mounted so that it can pivot on the baseplate with the interposition of means for centering it, guiding its rotation, and supporting it, a handrail in the shape of an arc of a circle connected to the plate by two uprights, and two wheels mounted so that they are free to rotate at the ends of an axle parallel to a diameter of the plate, outside the latter and arranged on the opposite side to the region via which this plate is accessed, the wheels being arranged in such a way that they come into contact with the ground only when the platform is tipped toward them, characterized in that the baseplate comprises a circular metallic disk of approximately the same diameter as the plate while, on the one hand, the plate, which also consists of a metal sheet, is secured to a protective circular edging extending right down to the baseplate and, on the other hand, lower members (4*a*) of the two uprights are connected by a horizontal crossmember which, placed at adult knee height, is itself reinforced by an inclined bar extending between this crossmember and the front part of the plate.

2. Platform according to claim 1, characterized in that each of the ends of the arc-shaped handrail is extended, beyond where it is attached to an upper member of the upright, by a return bent into a semicircle downward in the shape of a semicircle.

3. Platform according to claim 1, characterized in that the circular plate is extended forward by a rectangular and radial tang, to the front transverse edge of which there is welded, parallel to this edge, a metal rod, the protruding ends of which form an axle about which the wheels can rotate.

4. Platform according to claim 3, wherein the lower end of the reinforcing bar is welded to the tang of the plate.

5. Platform according to claim 1, characterized in that the lower end of the reinforcing bar is welded to a tang of the plate.

6. Platform according to claim 1, characterized in that the horizontal crossmember is connected to the lower members of the uprights by welding.

7. Platform according to claim 1, characterized in that the crossmember is surrounded by at least one sleeve made of an elastically compressible material.

8. Platform according to claim 1, characterized in that the means for guiding the rotation of the plate with respect to the baseplate comprises a vertical screw passing freely through an axial bore in the plate, and a countersunk head of which is inserted in a countersunk hole in this plate, while its shank is screwed into a nut that is an integral part of the baseplate.

9. Platform according to claim 1, characterized in that the means for supporting the plate comprises rollers, distributed in a circle with an angular spacing, between the plate and the baseplate, each roller being mounted so that it is free to rotate about a horizontal axle in a support fixed to the baseplate.

10. Platform according to claim 1, characterized in that the two uprights are telescopic.

* * * * *